United States Patent [19]

Kanno et al.

[11] Patent Number: 4,805,577

[45] Date of Patent: Feb. 21, 1989

[54] FUEL SUPPLY CONTROL APPARATUS FOR INTERNAL COMBUSTION ENGINE

[75] Inventors: Yoshiaki Kanno; Katsuya Nakamoto; Jiro Sumitani, all of Himeji, Japan

[73] Assignee: Mitsubishi Denki Kabushiki Kaisha, Tokyo, Japan

[21] Appl. No.: 210,188

[22] Filed: Jun. 22, 1988

Related U.S. Application Data

[63] Continuation of Ser. No. 29,765, Mar. 24, 1987, abandoned.

[30] Foreign Application Priority Data

Apr. 23, 1986 [JP] Japan ..... 61-93871
Apr. 23, 1986 [JP] Japan ..... 61-93872

[51] Int. Cl.[4] ..... F02D 41/10
[52] U.S. Cl. ..... 123/488; 123/492
[58] Field of Search ..... 123/492, 493, 488, 494

[56] References Cited

U.S. PATENT DOCUMENTS 3,818,877 6/1974 Barrera et al. ..... 123/494
4,388,906 6/1983 Sugiyama et al. ..... 123/492
4,454,847 6/1984 Isomura et al. ..... 123/492
4,512,319 4/1985 Williams et al. ..... 123/492

FOREIGN PATENT DOCUMENTS 23240 2/1983 Japan ..... 123/493
60025 12/1985 Japan .

*Primary Examiner*—Tony M. Argenbright
*Attorney, Agent, or Firm*—Burns, Doane, Swecker & Mathis

[57] ABSTRACT

A fuel supply control apparatus for an internal combustion engine comprises a detecting means for detecting the increment of air intake quantity for the internal combustion engine and a sensor for detecting temperature of the cooling water of the internal combustion engine so that the fuel supply quantity is increased according to the temperature of cooling water when the increment of air intake quantity is detected, thereby enabling rapid increment of fuel supply quantity according to the increment of the revolution of the engine and compensation of fuel supply loss, which is caused by adhesion of liquefying fuel inside the air intake pipe and the like, according to the temperature of cooling water.

2 Claims, 9 Drawing Sheets

FUEL SUPPLY CONTROL APPARATUS FOR INTERNAL COMBUSTION ENGINE

This application is a continuation of application Ser. No. 029,765, filed Mar. 24, 1987, now abandoned.

BACKGROUND OF THE INVENTION

1. Field of the Invention

The present invention relates to a fuel supply control apparatus for an internal combustion engine, and more particularly to a fuel supply control apparatus which detects by an air flow sensor an air intake quantity into the internal combustion engine to thereby control an optimum fuel supply to the internal combustion engine on the basis of the detected value of air intake quantity.

2. Description of the Prior Art

For fuel control of the internal combustion engine, an air flow sensor (to be hereinafter called AFS) is provided at the upstream side of a throttle valve so that an air intake quantity per one suction is obtained by the information from the AFS and the number of revolutions of the engine, thereby controlling the fuel supply quantity on the basis of the above data.

In the aforesaid conventional apparatus, however, a delay of computation of the air quantity occurs by a duration of one suction, because it carries out an operation of correcting the intake quantity. In its accelerating, a delay occurs in the detecting output of the intake quantity detecting means, in other words, the air flow sensor, because of the existence of air in the air intake pipe. Accordingly, there is a problem in that a fuel supply quantity becomes short.

In addition, the ratio of adhesion of the liquefying fuel to be supplied inside the air intake pipe varies according to the temperature of cooling water, in other words, the temperature of the internal combustion engine, thereby creating the problem in that the increase and decrease of the fuel supply quantity is not coincident with the real fuel quantity to be supplied to the internal combustion engine.

SUMMARY OF THE INVENTION

In order to solve the above problem the present invention has been designed.

A first object thereof is to provide a fuel supply control apparatus for an internal combustion engine with high responsibility, which enables the rapid increment of the fuel supply quantity during its accelerating.

A second object of the invention is to provide a fuel supply control apparatus for an internal combustion engine, which can compensate the fuel supply loss caused by adhesion of liquefying fuel inside the air intake pipe by adjusting the fuel supply quantity according to the detected temperature of cooling water thereof.

The fuel supply control apparatus for an internal combustion engine of the invention being provided with an air flow sensor for detecting the air intake quantity which is sucked into said internal combustion engine to be controlled, a revolution sensor which detects the number of revolutions of said internal combustion engine, an AN detecting means which detects the air intake quantity per one suction based on the output of said air flow sensor and the output of said revolution sensor, an AN computing means which computes the necessary fuel quantity based on said AN detecting means, and a control means which controls the fuel supply based on the output of said AN computing means, is characterized by comprising an incremental detecting means which detects the increment of detecting value of the air intake quantity by said air flow sensor, whereby when said incremental detecting means detects the increment of the air intake quantity, said control means increases the fuel supply quantity for said internal combustion engine.

The above and further objects and features of the invention will more fully be apparent from the following detailed description with accompanying drawings.

DESCRIPTION OF THE PREFERRED EMBODIMENT

Next, an embodiment of a fuel supply control apparatus of the present invention will be described with reference to the drawings.

Figure 1:
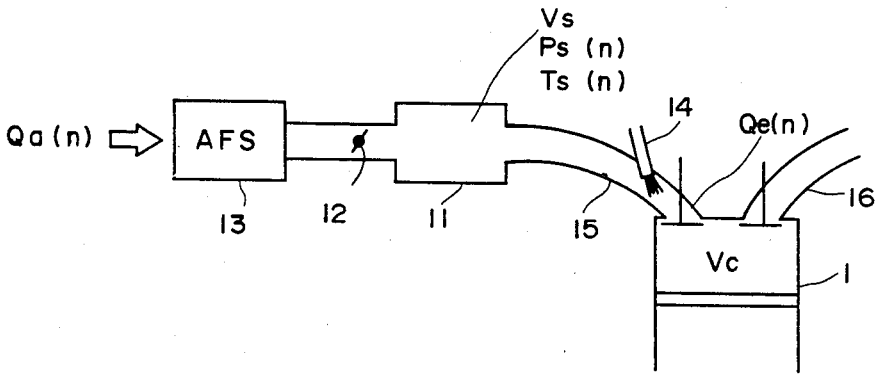
FIG. 1 is a structural view exemplary of an air intake system at the internal combustion engine.

FIG. 1 shows a model of an air intake system of an internal combustion engine, in which reference numeral 1 designates the internal combustion engine of a volume Vc per one stroke, sucked air through an air flow sensor (AFS) 13 of a Karman vortex flowmeter, a throttle valve 12, a surge tank 11 and an air intake pipe 15, and is supplied with fuel by an injector 14, a volume from the throttle valve 12 to the internal combustion engine 1 being represented by Vs. 16 designates an exhaust pipe.

Figure 2:
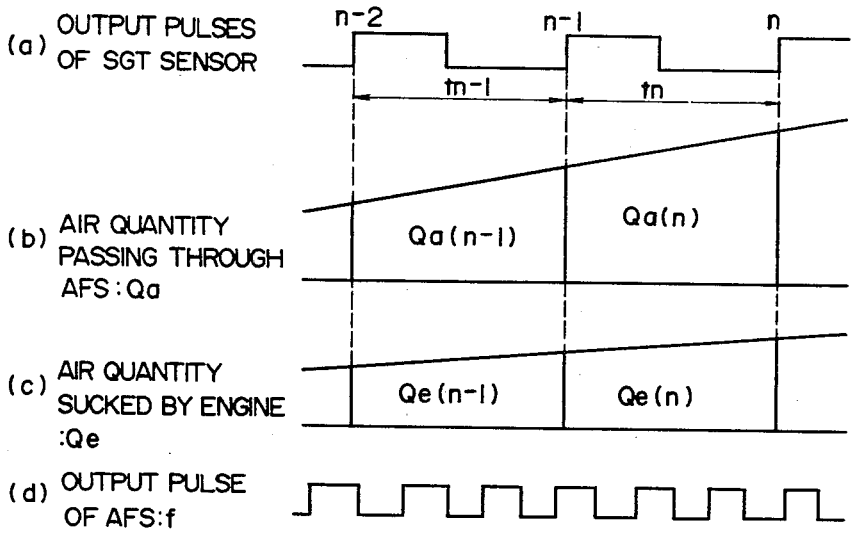
FIGS. 2(a–d) show a graph of an air intake quantity with respect to a crank angle of the internal combustion engine, FIGS. 3(a–f) show a wave form chart showing variation of the air intake quantity during the transition of the internal combustion engine.

FIG. 2 shows the relation between the air intake quantity and the predetermined crank angle at the internal combustion engine 1, in which FIG. 2-(*a*) shows the predetermined crank angle of the internal combustion engine 1 (to be hereinafter called the signal timing (SGT) indicated by an SGT sensor 17, FIG. 2-(*b*) shows an air quantity Qa passing through the AFS 13, FIG. 2-(*c*) shows an air quantity sucked by the internal combustion engine 1, and FIG. 2-(*d*) shows an output pulse f of the AFS 13. The duration from the (n−2)th leading edge of the (n−1)th leading edge at the SGT is represented by t(n−1), the duration from the (n−1)th leading edge to the (n)th leading edge by t(n), air intake quantity passing through the AFS 13 during the durations t(n−1) and t(n) are represented by Qa(n−1) and Qa(n) respectively, air intake quantity by the internal combustion engine 1 during the durations t(n−1) and t(n) are represented by Qe(n−1) and Qe(n). Furthermore, an average pressure and an average intake-air temperature within the surge tank 11 during the durations t(n−1) and t(n) are represented by Ps(n−1), Ps(n), Ts(n−1) and Ts(n) respectively, where, for example, Qa(n−1) corresponds to the number of output pulse f of AFS 13 during the duration t(n−1). Also, assuming that a rate of change of the intake-air temperature is small so as to be Ts(n−1) ≈ Ts(n) and the charging efficiency of internal combustion engine is constant, the following equations are obtained:

$$Ps(n-1)\cdot Vc = Qe(n-1)\cdot R\cdot Ts(n) \quad (1)$$

$$Ps(n)\cdot [Vc = Qe(n)\cdot R\cdot Ts(n) \quad (2)$$

where R is the constant. When an air quantity filled in the surge tank 11 and air intake pipe 15 during the duration t(n) is represented by ΔQa(n), the following equation is given:

$$\begin{aligned} \Delta Qa(n) &= Qa(n) - Qe(n) \\ &= Vs \cdot \frac{1}{R \cdot Ts(n)} \times (Ps(n) - Ps(n-1)) \end{aligned} \quad (3)$$

When a pressure difference Ps(n)−Ps(n−1) is obtained from the equations (1) and (2) and substituted into the equation (3), the following equation is obtained:

$$Qe(n) = \frac{1}{1+\frac{Vc}{Vs}} \cdot Qe(n-1) + \left(1 - \frac{1}{1+\frac{Vc}{Vs}}\right) \cdot Qa(n). \quad (4)$$

Accordingly, the air quantity Qe(n) taken-in by the internal combustion engine 1 for the duration t(n) can be computed by the equation (4) on the basis of the air quantity Qa(n) passing through the AFS 13. Here, assuming Vc=0.5 liter and Vs=2.5 liters, the following equation is given:

$$Qe(n) = 0.83 \times Qe(n-1) + 0.17 \times Q(n) \quad (5)$$

Figure 3:
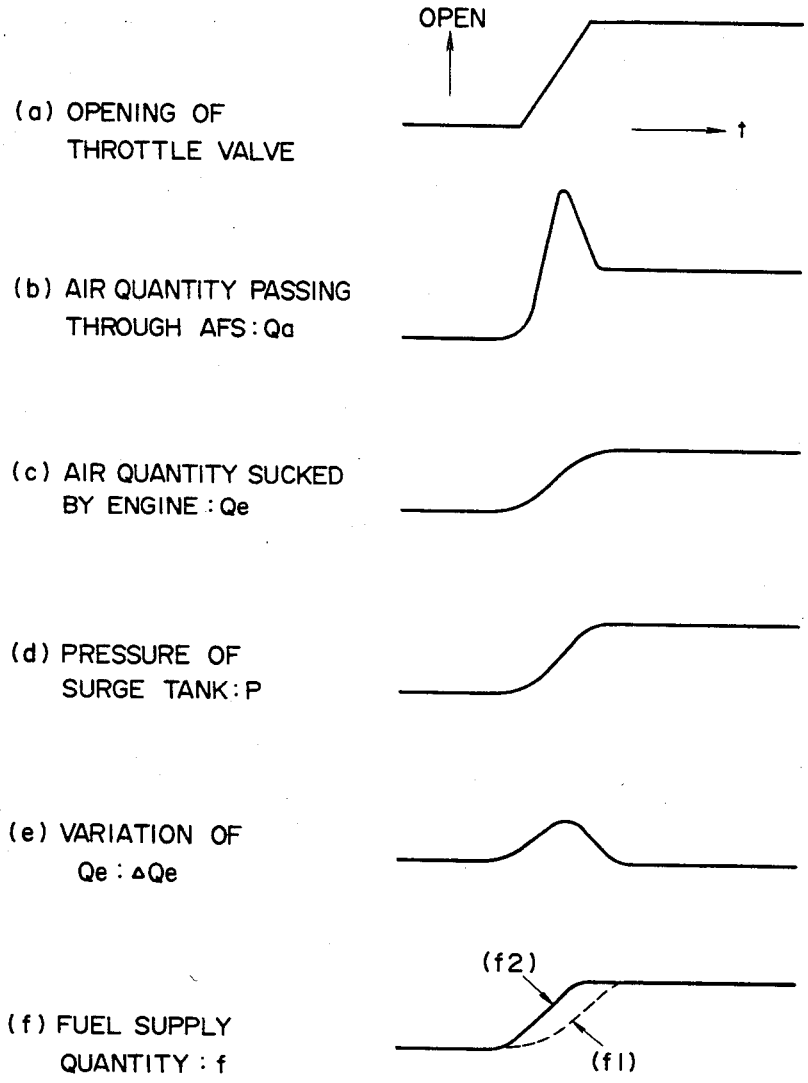

Next, FIG. 3 shows a condition of keeping the throttle valve 12 open, in which the FIG. 3-(*a*) shows the opening of the throttle valve 12, FIG. 3-(*b*) shows the air intake quantity Qa, which overshoots when the throttle valve 12 is open, FIG. 3-(*c*) shows the air quantity Qe taken-in by the internal combustion engine 1 and corrected by the equation (4), and FIG. 3-(*d*) shows pressure P in the surge tank 11. In addition, FIG. 3-(*e*) shows a ΔQe which is variation of Qe, and FIG. 3-(*f*) shows a fuel supply quantity f. And each of f1 and f2 is a result compensated based on Qe, ΔQe respectively.

Figure 4:
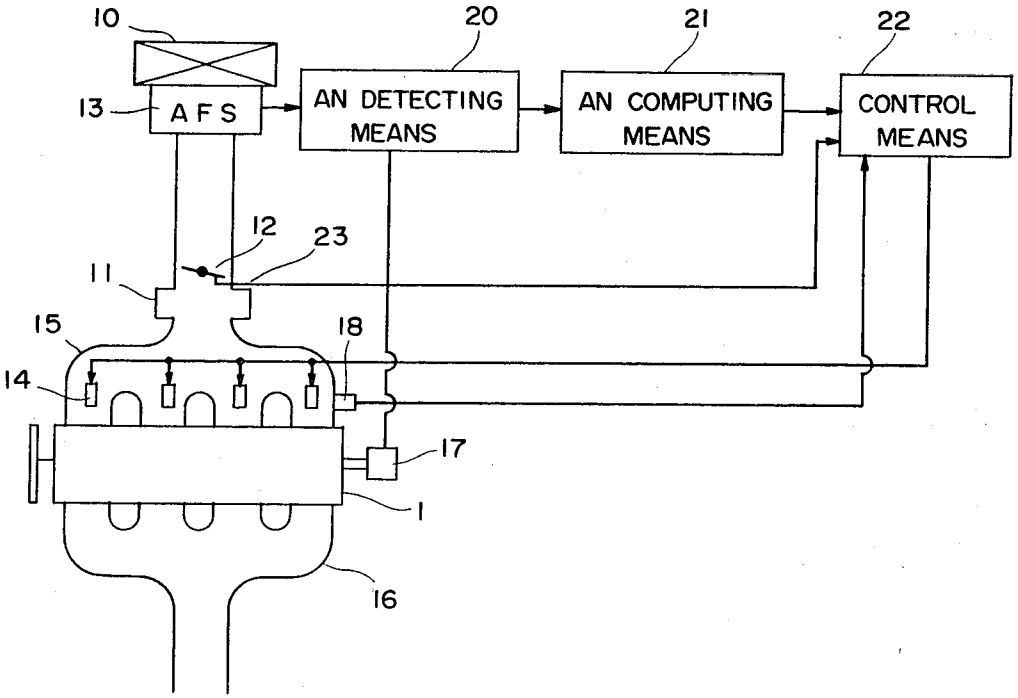
FIG. 4 is a block diagram of the fuel supply apparatus of the invention.

FIG. 4 is a block diagram of the fuel supply control apparatus for the internal combustion engine of the invention, in which reference numeral 10 designates an air cleaner disposed at the upstream side of the AFS 13, the AFS 13 outputting pulse as shown in FIG. 2-(*d*) corresponding to an air quantity taken in the internal combustion engine 1, and an SGT sensor 17 outputs pulse (for example, at a crank angle of 180° from the leading edge of pulse to the next leading edge thereof) as shown in FIG. 2(*a*) corresponding to the revolution of internal combustion engine 1, 20 designates an AN detecting means (where an air flow rate is represented by A and the engine speed by N so that AN is a ratio of air intake quantity to the number of revolution of the engine) for counting the output pulse number of the AFS 13 entering between the predetermined crank angles of the internal combustion engine 1, 21 designates an AN computing means which carries out computation similar to the equation (5) so as to obtain from the output of the AN detecting means 20 the pulse number equivalent to the output of the AFS 13 corresponding to the air quantity Qe deemed to be taken in the internal combustion engine 1, and 22 designates a control means which is given outputs from the AN computing means 21 and a water temperature sensor 18 (a thermistor, for example) for detecting a cooling water temperature for the internal combustion engine 1, so as to control by these outputs a driving time of the injectors 14 corresponding to the air quantity taken in the internal combustion engine, thereby controlling an quantity of fuel supplied thereto. And 23 designates a switch which detects the idling condition of the internal combustion engine 1.

Figure 5:
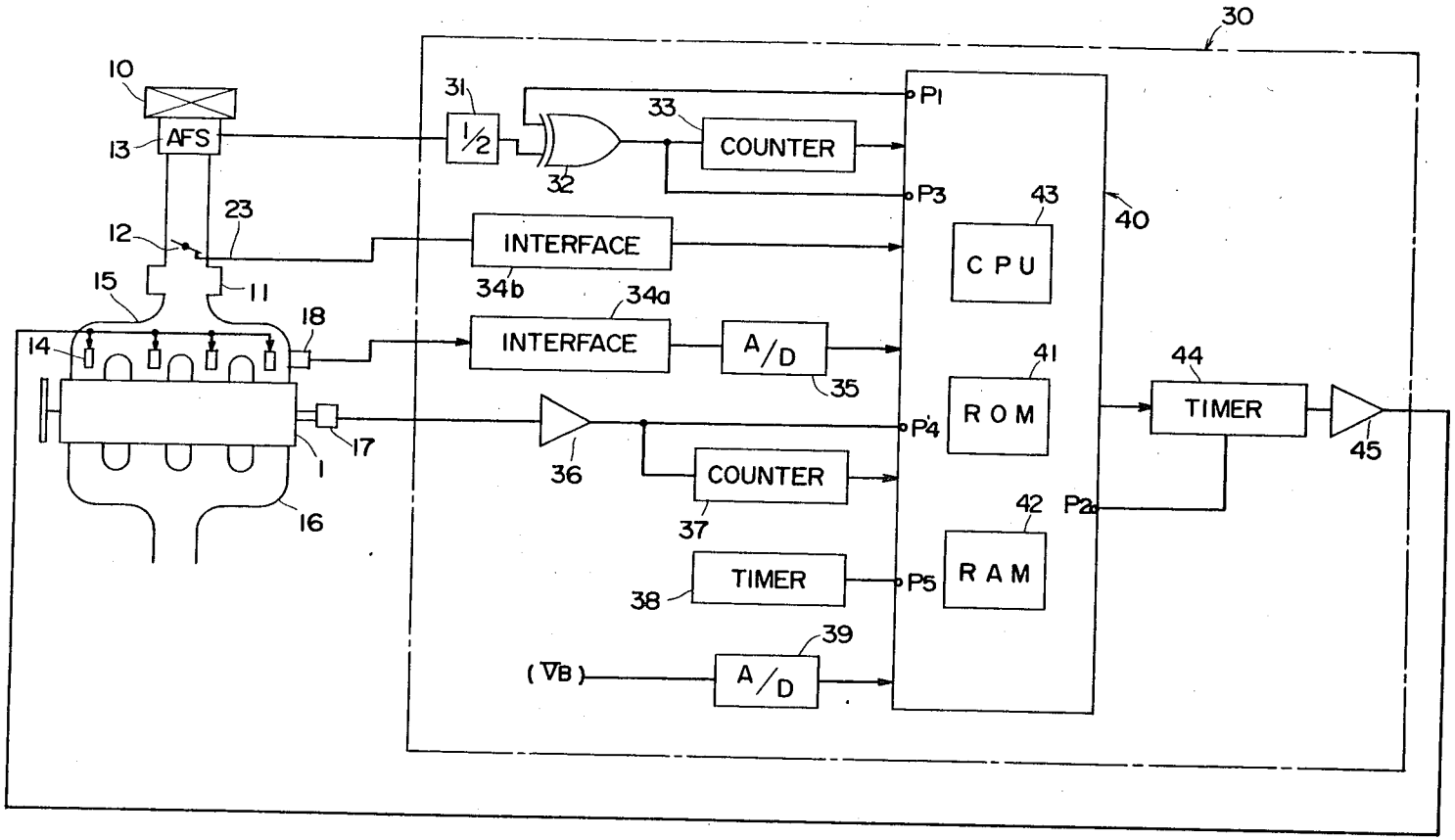
FIG. 5 is a detailed block diagram of the same, showing concrete construction thereof, FIGS. 6, 8, 9(*a*) and 9(*b*) are flow charts showing operation of the same.

FIG. 5 is a block diagram of further concrete construction of the embodiment of the present invention, in which reference numeral 30 designates a control system being given output signals from the AFS 13, the water temperature sensor 18, the SGT sensor 17 and the like, and controls the four injectors 14 provided at the respective cylinders of internal combustion engine 1, the control system 30 having functions corresponding to the AN detecting means 20, the AN computing means 21 and the control means 22 in FIG. 4, and being materialized with a microcomputer 40 having a ROM 41, a RAM 42 and a CPU 43. Also, reference numeral 31 designates a ½ frequency divider connected to the output of the AFS 13, 32 designates an exclusive OR gate which introduces at one input terminal the output of the ½ frequency divider 31 and connects at the other input terminal with an input port P1 at the microcomputer 40 and at an output terminal with a counter 33 and an input port P3 at the microcomputer 40, 34*a* designates an interface being connected between the water temperature sensor 18 and an A/D converter 35, 34*b* designates an interface being connected between the idle switch 23 and the microcomputer 40, 36 designates a waveform shaping circuit which introduces therein an output of the SGT sensor 17, the output of the waveform shaping circuit 36 being given to an interrupt input port P4 at the microcomputer 40 and a counter 37, 38 designates a timer connected to an interrupt input port P5 at the microcomputer 40, 39 designates an A/D converter for A/D-converting voltage (VB) of a battery (not shown) so as to output the A/D converted voltage to the microcomputer 40, and 44 designates a timer provided between the microcomputer 40 and a driver 45, the output of the driver 45 being connected to the respective injectors 14.

Next, explanation will be given on operation of the fuel supply apparatus of the invention constructed as the above-mentioned. The output of the AFS 13 is divided by the ½ frequency divider 31 and introduced into the counter 33 through the exclusive OR gate 32 controlled by microcomputer 40, the counter 33 measuring the duration of the trailing edge of the output from the gate 32. The trailing edge of the gate 32 is introduced into the interrupt input port P3 at the microcomputer 40 and the interruption is carried out every cycle of the output pulse of the AFS 13 or at every ½ divided frequency thereof, so that the microcomputer 40 measures the duration of the output pulse of the AFS 13 counted by the counter 33. The output of water temperature sensor 18 is converted into voltage by the interface 34a and converted into a digital value by A/D converter every predetermined time so as to be fetched in the microcomputer 40. The output of the SGT sensor 17 is given into the interrupt input port P4 of the microcomputer 40 and the counter 37 through the waveform shaping circuit 36. The output of the idle switch 23 is introduced into the microcomputer 40 through the interface 34*b*. The microcomputer 40 carries out the interruption at every leading edge of the output signal of the SGT sensor 17 to thereby detect from the output of the counter 37 the duration of leading edge of the output signal of the SGT sensor 17. The timer 38 generates an interrupt signal every predetermined time and gives it to the interrupt input port P5 of the microcomputer 40. The A/D converter 39 A/D-converts voltage (VB) of the battery (not shown), and the data of the battery voltage (VB) is fetched into the microcomputer 40 every predetermined time. The timer 44 is preset by the microcomputer 40 and triggered from the output port P2 thereof, thereby outputting pulse of a predetermined width. Hence, the output pulse drives the injectors 14 through the driver 45.

Figure 6:
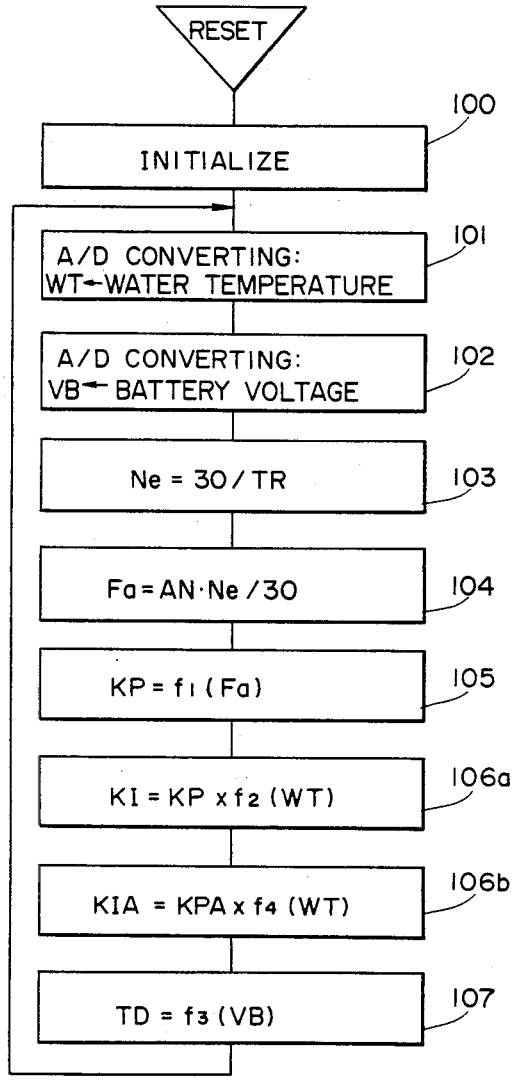
Figure 7:
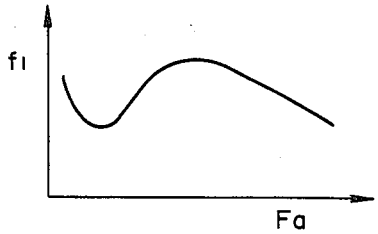
FIG. 7 is a graph showing the relation between the basic driving time conversion factor and the AFS output frequency, and FIGS. 10(*a–d*) show a timing chart showing the timing shown in the flow charts in FIGS. 8 and 9.

Next, explanation will be given on the control operation of a CPU 43 with reference to the flow charts in FIGS. 6, 8 and 9. At first, the main program of the CPU 43 is shown in FIG. 6.

The CPU 43, when given a reset signal, initializes the RAM 42 and input and output ports P1 through P5 (at the step 100), A/D converts the output of the water temperature sensor 18 and stores it as WT in the RAM 42 (step 101), A/D-converts battery voltage to store it as VB in the RAM 42 (step 102). And CPU 43 computes 30/TR from the duration TR of output pulse of the SGT sensor 17 to thereby compute the number of revolutions Ne of the engine 1 (step 103), and further computes AN·Ne/30 from the load data AN to be discussed below and the number of revolutions Ne of the engine, thereby obtaining the output frequency Fa of the AFS 13 (step 104).

Figure 9A:
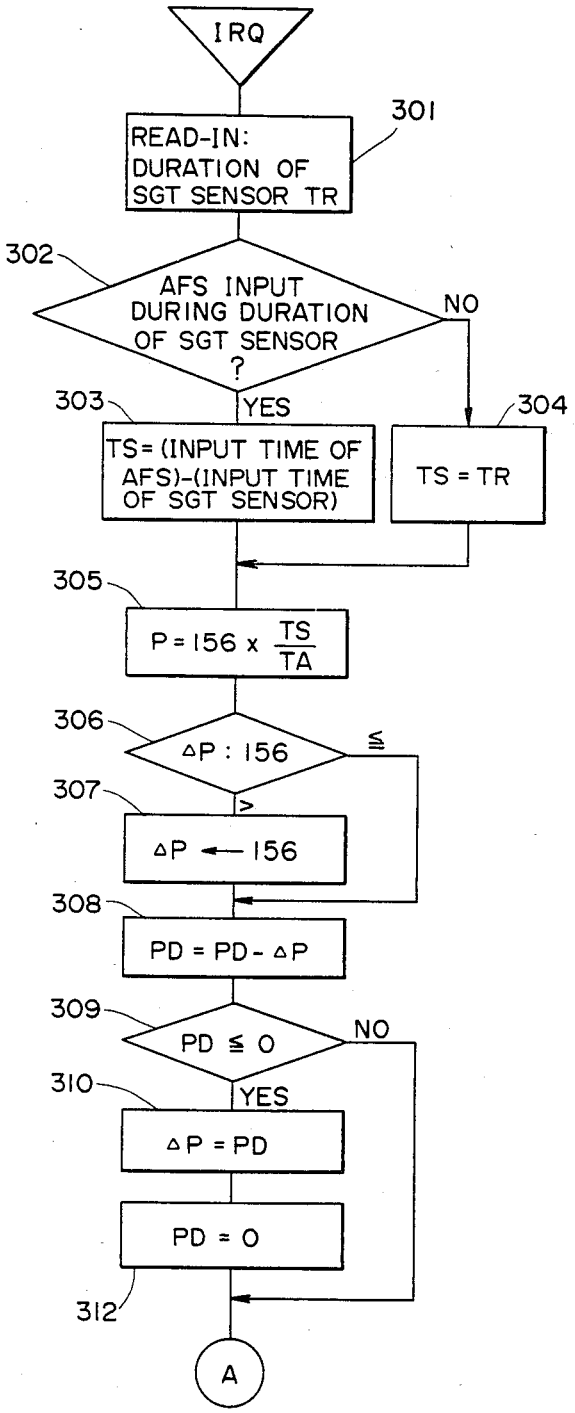
Figure 9B:
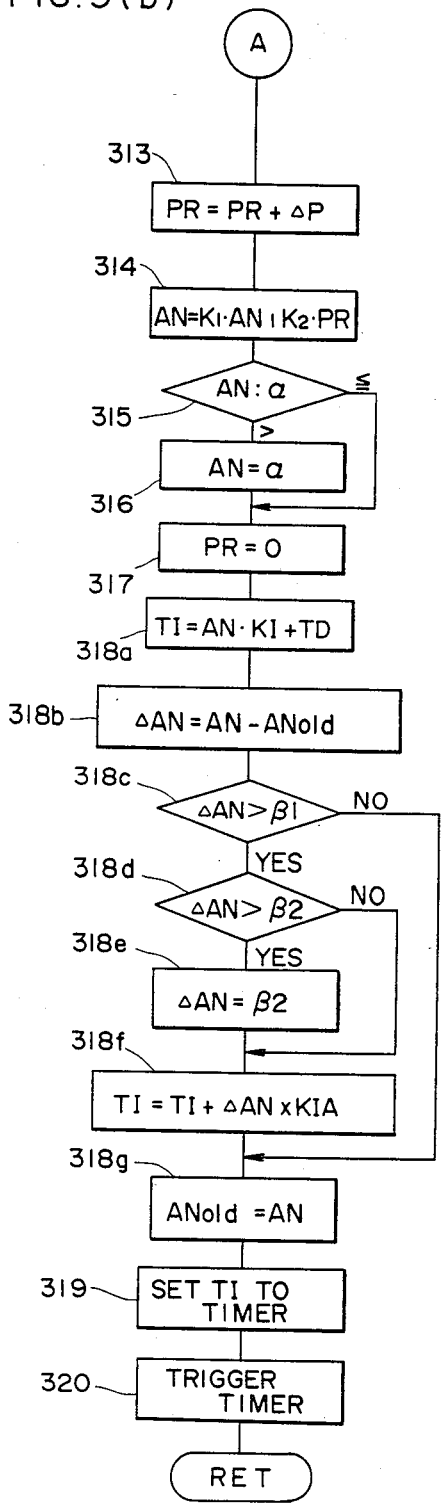

Also, the CPU 43 computes a reference drive time conversion factor Kp by the output frequency Fa of the AFS 13 on the basis of a factor f1 set with respect to the Fa in the relation as shown in the graph of the FIG. 9 (step 105).

And it corrects the conversion factor Kp by the water temperature data WT and stores in the RAM 42 the corrected factor as a drive time conversion factor K1 (step 106*a*). The CPU 43 corrects a reference drive time conversion factor of the fuel in its varying duration in speed and quantity KpA, by the water temperature data WT and stores in the RAM 42 the corrected factor as a drive time conversion factor KIA (step 106*b*). That is to say, in a case when the temperature of cooling water is low, more liquefying quantity of fuel to be supplied adheres to the inside of the air intake pipe 15, thereby more fuel supply loss occurs. Conversely, in a case when the temperature of cooling water is high, less liquefying quantity of fuel to be supplied adheres thereto, thereby less fuel supply loss occurs.

And maps a data table f3 previously stored in the ROM 41 in accordance with the battery voltage data VB and computes a dead time TD to be stored in the RAM 42 (step 107). The processing after the step 107 is repeated in the order from the step 101.

Figure 8:
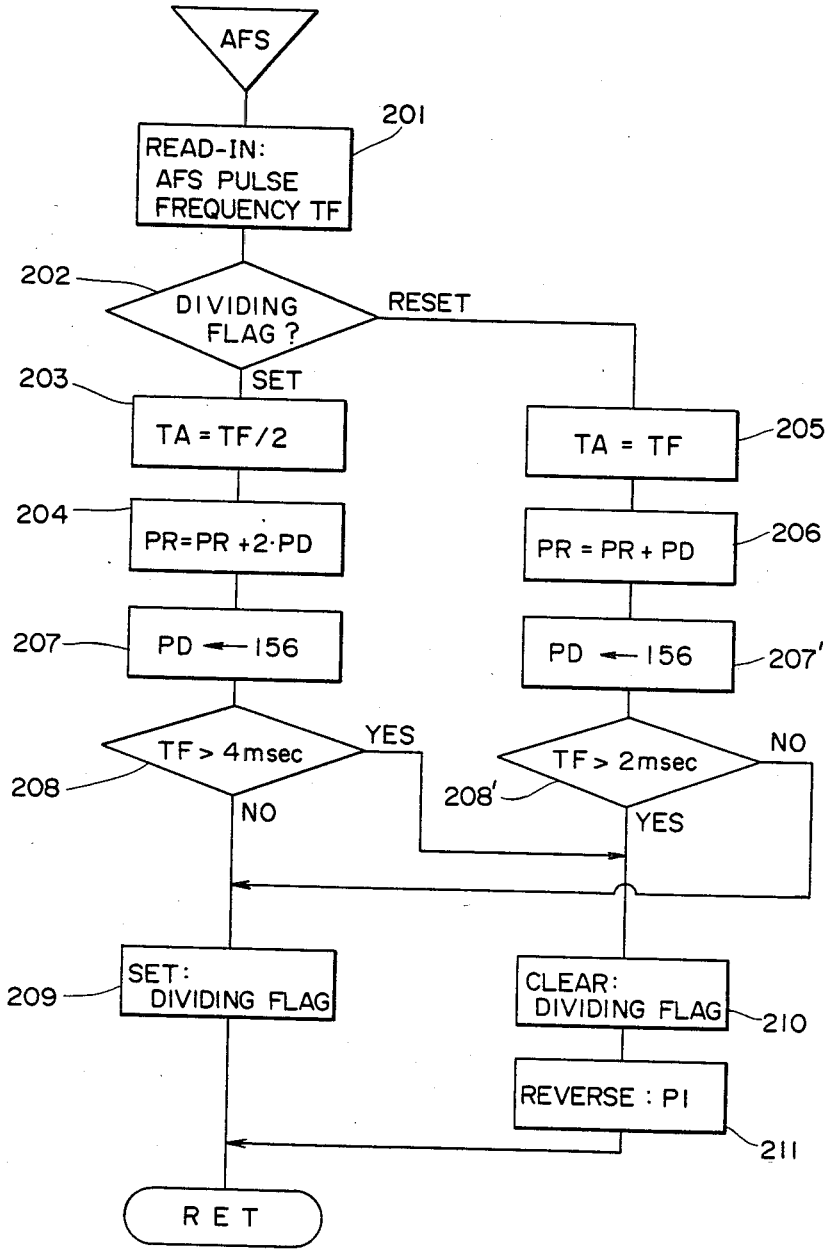

FIG. 8 shows the interrupt processing of the interrupt input port P3, in other words, the interrupt processing with respect to the output signal of the AFS 13. The CPU 43 detects the output TF of the counter 33 and thereafter clears the counter 33 (step 201), the output TF thereof corresponding to the duration of leading edge of the output of the gate 32. Also, the CPU 43, when the dividing flag in the RAM 42 is set (step 202), divides TF in two and stores it as the output pulse duration TA of the AFS 13 in the RAM 42 (step 203), next, adds to the integrating pulse data PR the two-fold residual pulse data PD to make new integrating pulse data PR (step 204), the integrating pulse data PR integrating the pulse number of the AFS 13 outputted for the duration of leading edge of output pulse from the SGT sensor 17 and multiplied by 156 for operation with respect to one pulse of the AFS 13 for the convenience of processing.

When the dividing flag is reset (step 202), the CPU 43 stores in the RAM 42 the duration TF as the output pulse duration TA of the AFS 13 (step 205), adds to the integrating pulse data PR the residual pulse data PD (step 206), and sets numeral 156 as the residual pulse data PD (step 207). In a case where the dividing flag is reset and when TF > 2msec (step 208'), and in a case where the same is set and when TF>4msec (step 208), the processing is transferred to the step 210, and in a case other than the above, the processing is transferred to the step 209. The CPU 43 sets the dividing flag (step 209), clears it (step 210), and inverts the output signal of the output port P1 (step 211). Accordingly, for the processing (step 209), the signal is given to the interrupt input port P3 at the timing of dividing into half the output pulse of the AFS 13. For the processing (step 210), the signal is given to the interrupt input port P3 at every output pulse of the AFS 13, thereby completing the interruption after the steps 209 and 211.

FIG. 9 is a flow chart of the interruption when an interrupt signal is generated from the output of the SGT sensor 17 so as to be given to the interrupt input port P4 of the CPU 43.

The CPU 43 reads out the duration of leading edge of the output signal of the SGT sensor 17 as the timing value by the counter 37, stores it as the duration TR in the RAM 42, and clears the counter 37 at the step 301. Also, the CPU 43, when the output pulse of the AFS 13 is in the duration TR (step 302), computes a time difference $\Delta t = t02 - t01$ between the time t01 of the just preceding output pulse of the AFS 13 and the present interrupt time t02 of the SGT sensor 17, and deems the time difference to be duration Ts (step 303), and when the output pulse of the AFS 13 is not in the duration TR (step 302), deems TR to be Ts (step 304).

The CPU 43, when the flag is reset, computes $\Delta P = 156 \times Ts/TA$ (step 305), thereby converting the time difference Δt into the output pulse data of the AFS 13. In other words, the former output pulse duration of the AFS 13 and the present output pulse duration of the same are assumed to be the same so as to compute the pulse data ΔP.

When the pulse data ΔP is smaller than 156 (step 306), the processing is jumped to the step 308 and, when larger, clipped to 156 (step 307) and thereafter jumped to the step 308. The CPU 43 subtracts the pulse data ΔP from the residual pulse data PD to obtain the new residual pulse data PD (step 308). When the residual data PD is positive or zero (step 309), the processing is jumped to the step 313, and, when not so, the computed value of pulse data ΔP is much larger than the output pulse of the AFS 13, whereby the CPU 43 equalizes the pulse data ΔP to the residual pulse data PD (step 310) and makes zero the residual pulse data PD (step 312).

The CPU 43 adds the pulse data ΔP to the integrating pulse data PR to be the new integrating pulse data (step 313). The updated integrating pulse data PR corresponding to the pulse number deemed to be output from the AFS 13 during the leading edge of the output pulse from the SGT sensor 17. Computation corresponding to the equation (5) is carried out (step 314). In other words, the CPU 43, on the basis of the load data AN and integrating pulse data PR computed until the former leading edge of the output signal of the SGT sensor 17, thereby computing $AN=K1 \cdot AN+K2 \cdot PR$, so that the results of computation are used as the present new load data AN.

Here, K1 and K2 ($K2=1-K1$) are the filter constants respectively, and is decided on the basis of the factor $$\frac{1}{1+\frac{Vc}{Vs}}$$

in the equation (4).

Also, the load data AN is obtained as the result of filter-processing the detected value Qa of AN detecting means. Further concretely, the load data AN corresponds to the equation (5).

Next, the CPU 43, when the load data AN is larger than a predetermined value $\alpha$ (step 315), clips AN to $\alpha$, so that, even when the internal combustion engine 1 is fully open, the load data AN is restrained from exceeding the actual value (step 316). Then, the CPU 43 clears the integrating pulse data PR (step 317).

The CPU 43 computes from the load data AN, driving time conversion factor KI, and dead time TD, the driving time data $TI=AN \cdot KI+TD$ (step 318*a*). And it computes the difference ΔAN between the new load data AN and the last load data ANold, thereby judges whether ΔAN is larger than $\beta 1$ or not (step 318*c*) and when it is smaller, the processing is jumped to the step 318g. While, when $\Delta AN>\beta 1$, the CPU 43 judges whether ΔAN is larger than $\beta 2$ or not (318*d*), and when it is smaller, the processing is jumped to the step 318*f*, and when it is larger, ΔAN is clipped to $\beta 2$ (step 318*e*), thereafter the processing is jumped to the step 318*f*. Then the driving time data TI is computed by TI, ΔAN and KIA, and CPU 43 renews the data as $ANold=AN$, thereafter stored it in the RAM 42 (step 318g).

And the CPU 43 sets the driving time data TI at the timer 43 (step 319), and triggers the timer 43 (step 320). Hence, the four injectors 14 are driven simultaneously, thereby finishing the interruption.

Figure 10:
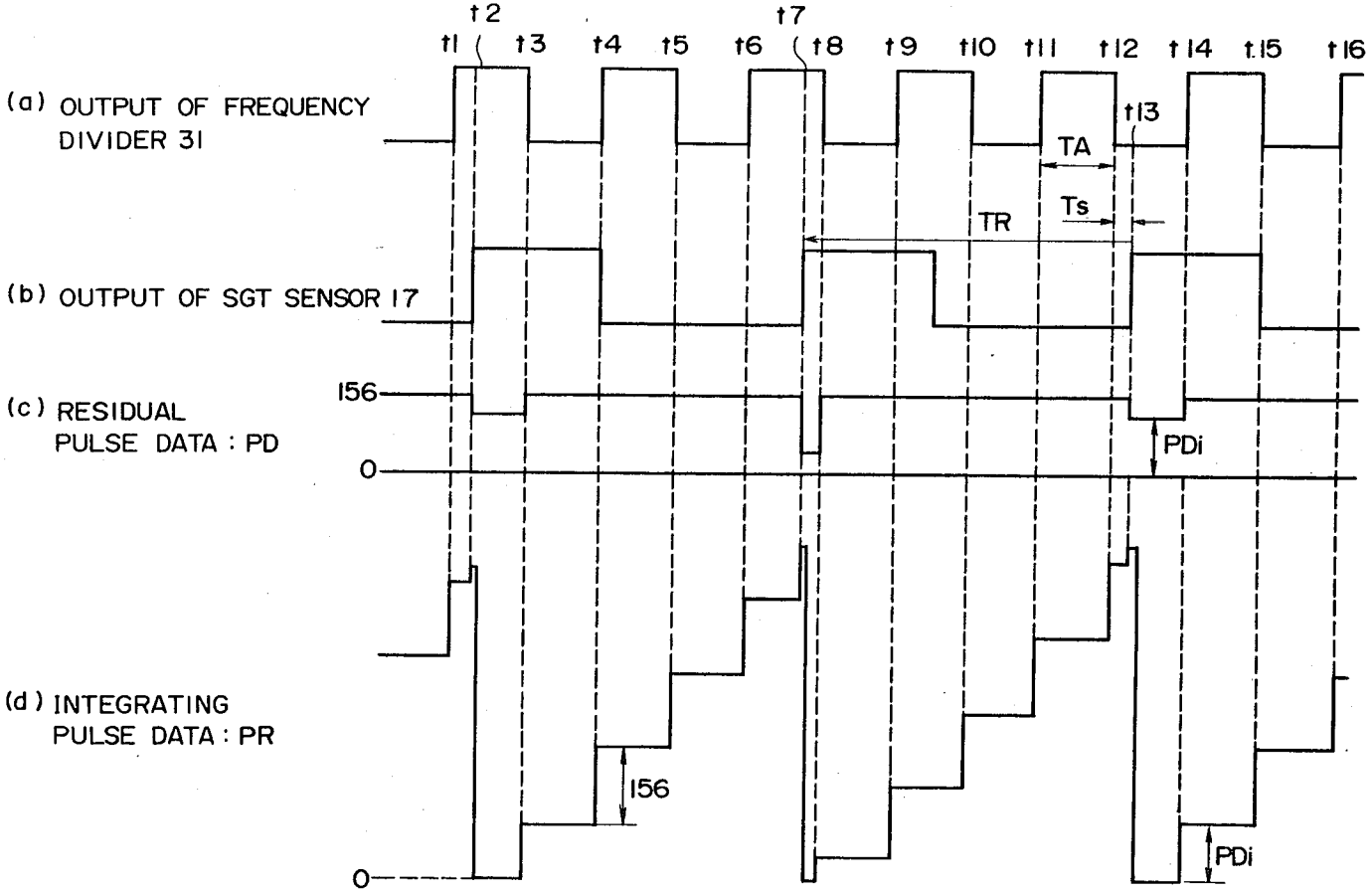

FIG. 10 shows the timing when the dividing flag is cleared in the processing shown in FIGS. 6, 8 and 9. FIG. 10-(*a*) shows an output of a frequency divider 31, FIG. 10-(*b*) shows an output of the SGT sensor 17, FIG. 10-(*c*) shows the residual pulse data PD which is set to 156 at every leading edge and trailing edge (in other word, the leading edge of output pulse of the AFS 13) of the frequency divider 31 and changed to the computation result of, for example, $PDi=PD-156 \times Ts/TA$ at every leading edge of the output signal of the SGT sensor 17 (corresponding to the processings of the step 305 through the step 312 in FIG. 9), and FIG. 10-(*d*) shows variation in the integrating pulse data PR and the mode of integrating the residual pulse data PD at every leading or trailing edge of frequency divider 31.

In addition, in the aforesaid embodiment, the output pulses of the AFS 13 between the leading edges of the signal from the SGT sensor 17 are counted, which may alternatively be counted between the trailing edges, or the output pulse number of the AFS 13 for several durations of the signal from the SGT sensor may be counted. Also, the output pulse number multiplied by the constant corresponding to the output frequency of the AFS 13 may be counted. Furthermore, it is similarly effective to detect the crank angle not by the SGT sensor 17 but by an ignition signal for the internal combustion engine 1.

As seen from the above, the fuel supply control apparatus of the invention enables the rapid increment of fuel supply according to the increment of the revolution of internal combustion engine and compensation of fuel supply loss, which is caused by adhesion of liquefying fuel inside the air intake system, according to the temperature of cooling water. Accordingly the fuel supply apparatus for an internal combustion engine with high responsibility to the increment of the revolution of engine is realized.

As this invention may be embodiment in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A fuel supply control apparatus for an internal combustion engine comprising:

an air flow sensor for detecting an air intake quantity which is sucked into said internal combustion engine to be controlled, a revolution sensor which detects the number of revolutions of said internal combustion engine, an AN detecting means for detecting synchronously with each revolution the air intake quantity per each suction of said internal combustion engine on the basis of an output of said air flow sensor and said revolution sensor, an AN computing means for damping an output of said AN detecting means, synchronously with each revolution, a control means for controlling a fuel supply to said internal combustion engine on the basis of an output of said AN computing means, an air intake incremental detecting means for detecting an incremental value of the output of said AN computing means at each damping cycle, a means for increasing fuel supply quantity to said internal combustion engine on the basis of the output of said AN computing means corrected by the incremental value of the output thereof, when said air intake incremental detecting means detects that the incremental value of the output of said AN computing means is larger than a predetermined value.

2. A fuel supply control apparatus for an internal combustion engine as set forth in claim 1, wherein an upper limit is set at the increment of fuel supply quantity for said internal combustion engine.

* * * * *